United States Patent [19]

Törnqvist

[11] 4,046,092

[45] Sept. 6, 1977

[54] SHIP'S HULL

[76] Inventor: Bengt Wilhelm Törnqvist, Hovslagargatan 5 B, 111 48 Stockholm, Sweden

[21] Appl. No.: 671,735

[22] Filed: Mar. 29, 1976

[30] Foreign Application Priority Data

Apr. 30, 1975 Sweden ..... 7505103

[51] Int. Cl.[2] ..... B63B 1/04

[52] U.S. Cl. ..... 114/56

[58] Field of Search ..... 114/26, 56, 63, 72, 114/73

[56] References Cited

U.S. PATENT DOCUMENTS

| | | | |
|---|---|---|---|
| 1,425,243 | 8/1922 | Duthie, Sr. | 114/56 |
| 3,038,432 | 6/1962 | Goldman | 114/72 |
| 3,437,066 | 4/1969 | Schwendtner | 114/43.5 VC |
| 3,489,117 | 1/1970 | Messerschmidt | 114/56 |
| 3,842,771 | 10/1974 | Murata | 114/56 |
| 3,881,438 | 5/1975 | Jones, Jr. | 114/56 |
| 3,889,619 | 6/1975 | Glassmeyer | 114/26 |
| 3,938,457 | 2/1976 | Dwyer | 114/56 |

*Primary Examiner*—Trygve M. Blix
*Assistant Examiner*—Stuart M. Goldstein

[57] ABSTRACT

A displacement ship for the transport selectively of low and high density cargo includes a hull having a trapezoidal cross-section and extending between the stem and stern of the ship. The sides of the hull form an angle of from 35° to 55° with the horizontal and extend upwardly above the design water line of the ship a distance at least equal to one-fourth the height of the hull. The upper extremities of the side walls of the hull terminate at the main deck of the ship which is coextensive lengthwise with the hull. At least one additional deck adapted to store low-density cargo thereon and coextensive in length and width with the main deck is positioned thereabove.

5 Claims, 2 Drawing Figures

SHIP'S HULL

BACKGROUND OF THE INVENTION

The invention relates to the hull of a cargo ship for carriage of, inter alia, bulky, comparatively light cargo, such as certain forest products, containers, motor vehicles etc., either alone or in combination with comparatively heavy cargo, e.g. in the form of oil, ore coal etc., or alternatively of such heavy cargo alone.

There has arisen in the ship industry a growing need to transport goods which are bulky in relation to its weight. An example is container-packed goods, the weight of which per volume unit of cargo space may be considerably less than one tenth of the density of water. Another example of "light" goods commonly transported by ship is motor vehicles, the weight of which per volume of cargo space is considerably less than 10% of the density of water.

The need to transport forest products, containers, motor vehicles and other "light" goods has necessitated large cargo space, which has resulted, inter alia, in new designs for the hulls of ships. The shipbuilding technicians have therefore been forced to a large extent to design different types of hull for different purposes.

A tendency to construct specially formed ships' hulls has thus become noticeable, each type of hull being designed to meet a specific transportation requirement. This development may be economically favourable in many respects, but in international shipping it has led to new, relatively unforeseen problems. A ship with high tonnage but relatively low displacement must, of course, be a shallow-draught vessel, which has an unfavourable effect on its stability and propulsion. Furthermore, specially constructed ships are generally unsuited for the transport of goods other than those for which they have been designed. This means that a not inconsiderable portion of all shipping at present runs at full load only in one direction, necessitating the reservation of large space for ballast tanks so that the ships can be given the necessary stability and draught when running without load.

SUMMARY OF THE INVENTION

The object of the present invention is to provide a ship's hull which enables optimal use to be made both of loading capacity and tonnage and thereby to produce a ship which can advantageously transport different kinds of cargo simultaneously or carry exclusively either light, bulky cargo or heavy, less bulky cargo.

The hull according to the invention has several manifest advantages over hulls known hitherto, the following of which advantages deserve special mention:

a. The ship can with little ballast be propelled without cargo with good stability and draught, b. A relatively large proportion of the ship's loading capacity can be assigned to the main deck and above on large loading areas without manifestly unfavourable effect on the stability of the ship, using bottom tanks and possibly wingward tanks only to a small extent as ballast tanks, c. Relatively heavy, less bulky cargo can be placed in holds below the main deck without need to fill the ballast tanks, d. The draught required for stability and propulsion of the ship can be maintained even with extremely light or no cargo.

As the costs of loading and discharging of cargo vessels constitute a large part of the total cost of transport, it is important that cargo vessels be constructed so as to facilitate loading and discharging in all respects. The costs so saved can far outweigh any increase of costs for propulsion of the vessel. With a form *af* hull according to the invention, furthermore, different kinds of cargo can be combined in such a way that the vessel's total loading capacity — as regards both volume and weight — can be optimally utilized, and the voyage made without cargo reduced to a minimum.

The great width attainable for a vessel built on a hull according to the invention enables the use of large continuous loading areas which facilitates the rapid loading and discharging of cargo onto trucks or other vehicles, since they can be easily manoeuvred on the large areas offered by the decks.

This new form of hull, furthermore, solves a problem to which only little attention has been paid hitherto, namely the limited water line breadth which in practice exists when running in ice-covered waters. The icebreakers presently in use, and those which in the foreseeable future will come into use, are not capable of breaking ice-channels of the width which may be necessary for ships with the loading width that can be attained with the hull according to the invention.

The hull according to the invention also offers the possibility of utilizing a recently known technique in the construction of a vessel for combined light and heavy cargo, utilizing longitudinal loading conveyors arranged under the main deck. The upper part of the space of essentially triangular cross-section that is formed wingwards in a hull according to the invention is well suited to house fore-and-aft conveyors for loading bulk cargo or the like via stem or stern. The main deck and any cargo decks above it can thus be free from hatches. The said space is also well suited for running of pipelines, electric cables etc.

For further understanding of the invention one of its embodiments will now be described with reference to the attached drawings, which show a hull according to the invention.

DESCRIPTION OF THE PREFERRED EMBODIMENT

Figure 1:
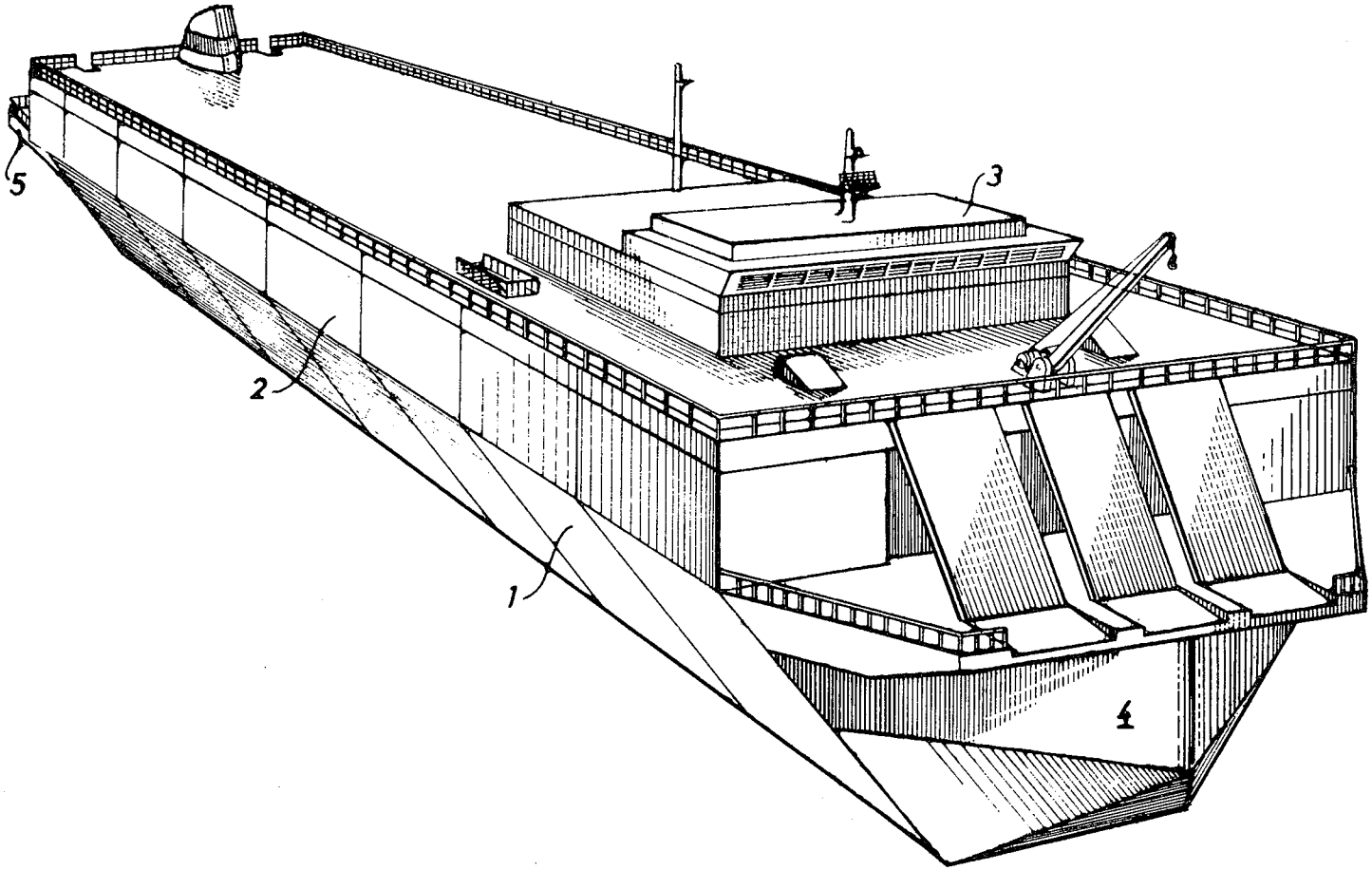
FIG. 1 is a perspective view of a ship having a hull according to the invention.

Referring to the drawings the ship has a lower section 1 and superstructures 2, 3. The lower section or hull 1 between the stem 4 and stern 5 of the ship is essentially trapezoidal in cross-section. The ship's plating 6', 6'' thus inclines about 45° to the main deck 7 and to the bottom 8 of the ship. However, the sides of the hull may be inclined relative to the horizontal at any suitable angle within the range of from 35° to 55°.

Further the side walls of the hull extend upwardly so as to intersect overlying main deck at a location above the design water line of the ship a distance at least equal to one-fourth the height of the hull.

The hull according to the invention thus differs markedly from hitherto known shapes of hulls in that the part immediately above the water line, together with the entire part below the water line, has an essentially trapezoidal cross-section instead of an essentially rectangular cross-section. This permits the construction of a hull of considerable width at the main deck so that, with the same good stability and the necessary draught, the ship can obtain the large tonnage required for the transport of the relatively light cargoes which are becoming increasingly predominant.

The new form of ship's hull according to the invention has the advantage, furthermore, that, when carrying exclusively light cargo or no cargo, the ship need not take in ballast to nearly the same extent as conventional ships. If the ballast tanks are placed in the ship's bottom, stability is obtained when running with light cargo above the main deck. When running without cargo only a fraction of the ballast required under corresponding conditions for a conventional ship is required. Stability calculations have shown that about 90% of the total loading capacity of the ship can be placed on the main deck and above without jeopardizing its stability.

Figure 2:
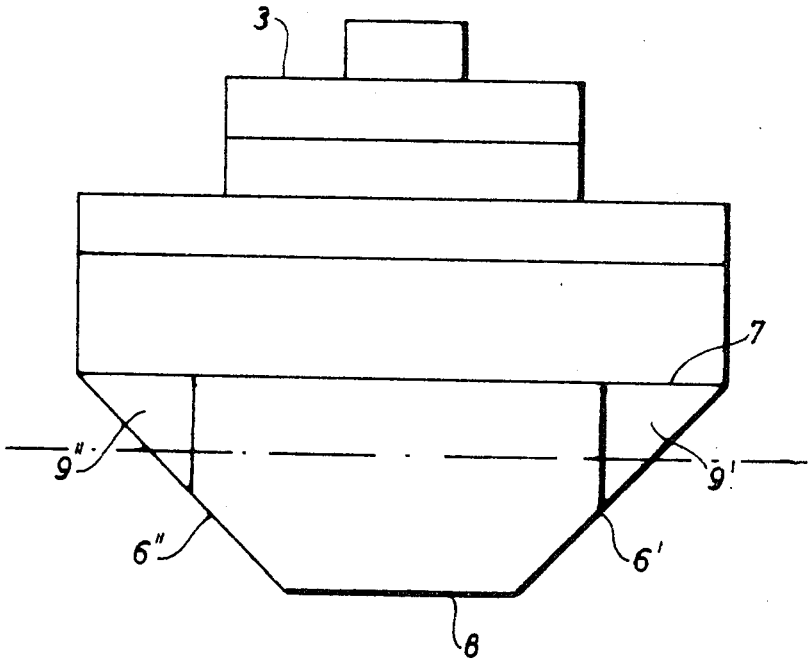
FIG. 2 is an elevational view of the ship shown in FIG. 1 at an intermediate location longitudinally thereof.

The form of hull according to the invention makes possible a favourable solution of other problems involved in the loading and discharging of different kinds of goods. Thus, as stated earlier, the upper wingward spaces denoted 9', 9'' in FIG. 2 can be used for the installation of pipelines, conveyor equipment or the like and is especially useful in the loading and discharging of oil, ore, coal or the like to and from holds below the main deck via stem or stern. The main deck 7 and any cargo decks above it need not be provided with hatches and can have virtually unbroken surfaces. This means that a cargo stored below the main deck can be discharged or loaded even if the cargo decks above the main deck are fully loaded such as with a low-density cargo.

A vessel according to the invention can thus be optimally utilized whether for heavy cargo, solely light cargo or for a combination of heavy and light cargo. The hull also allows loading and discharging of selected holds regardless of whether or not other holds are fully loaded.

Although the invention has been described with reference to one of its embodiments, it may be arbitrarily varied within the scope of the subsequent claims.

What I claim is:

1. A displacement ship for the transport selectively of low and high density cargo comprising: a hull which is substantially uniformly trapezoidal in cross-section and extends between stem and stern of the ship, said hull having downwardly and inwardly inclined side walls forming an angle of from 35° to 55° with the horizontal; a main deck surmounting said hull and coextensive lengthwise therewith, said side walls of the hull extending upwardly above the design water line of the ship a distance at least equal to one-fourth the height of the hull and terminating at said main deck; and at least one additional cargo deck coextensive in length and width with said main deck and positioned thereabove.

2. A displacement ship according to claim 1, including longitudinally extending wingward spaces within said hull projecting above and below the design water line of the ship, said wingward spaces being adapted to carry conveying means therein for the loading and unloading of the hull with a high-density bulk cargo.

3. A displacement ship according to claim 1, wherein said side walls of the hull are inclined at an angle of substantially 45° with the horizontal.

4. A displacement ship according to claim 1, wherein said decks are substantially free of hatches.

5. A displacement ship according to claim 2, wherein each said wingward space is of triangular cross-section and is formed by a vertical bulkhead extending upwardly from an intermediate location of the corresponding side wall of the hull, by a portion of said main deck, and by the portion of said corresponding side wall of the hull extending upwardly from said intermediate location.

* * * * *